US011330884B2

(12) United States Patent
deGrood et al.

(10) Patent No.: US 11,330,884 B2
(45) Date of Patent: May 17, 2022

(54) AIR-MOVING APPLIANCE INCLUDING AN ATTACHMENT

(71) Applicant: Spectrum Brands, Inc., Middleton, WI (US)

(72) Inventors: Michael John deGrood, Madison, WI (US); Jay William Kuzia, Madison, WI (US)

( * ) Notice: Subject to any disclaimer, the term of this patent is extended or adjusted under 35 U.S.C. 154(b) by 0 days.

(21) Appl. No.: 16/851,893

(22) Filed: Apr. 17, 2020

(65) Prior Publication Data

US 2020/0237070 A1 Jul. 30, 2020

Related U.S. Application Data

(63) Continuation of application No. 15/650,606, filed on Jul. 14, 2017, now Pat. No. 10,660,418.

(51) Int. Cl.
*A45D 20/12* (2006.01)
*A45D 20/10* (2006.01)

(52) U.S. Cl.
CPC ..... *A45D 20/12* (2013.01); *A45D 20/10* (2013.01); *A45D 20/122* (2013.01)

(58) Field of Classification Search
CPC ..... A45D 20/00; A45D 20/12; A45D 20/122; A45D 20/124
See application file for complete search history.

(56) References Cited

U.S. PATENT DOCUMENTS 4,308,670 A * 1/1982 Bonnema ..... A45D 20/50 132/219
4,309,595 A 1/1982 Long et al.
4,596,921 A * 6/1986 Hersh ..... F24H 3/0423 181/225

(Continued)

FOREIGN PATENT DOCUMENTS

CN 103369982 A 10/2013
EP 980499 A1 2/2000

(Continued)

OTHER PUBLICATIONS

European Patent Office, Search Report and Opinion, dated Feb. 19, 2019, pp. 3-13.

(Continued)

*Primary Examiner* — Gregory A Wilson
(74) *Attorney, Agent, or Firm* — Armstrong Teasdale LLP

(57) ABSTRACT

An air-moving appliance includes a body extending about an axis. The body includes an inner wall and an outer wall spaced radially outward from the inner wall. The inner wall and the outer wall define a cavity therebetween. The inner wall defines a central passage. The air-moving appliance also includes an inlet and an outlet. The air-moving appliance further includes an attachment configured to selectively connect to the body in flow communication with the outlet. The attachment includes a connector configured to extend into the central passage defined by the inner wall of the body and an attachment inlet configured to receive the airflow that exits the cavity of the body through the outlet. The attachment inlet is circumferentially disposed about the axis and the central passage defined by the inner wall of the body when the attachment is connected to the body.

19 Claims, 20 Drawing Sheets

(56) References Cited

U.S. PATENT DOCUMENTS

| | | | | |
|---|---|---|---|---|
| 4,903,416 | A * | 2/1990 | Levin | A45D 1/02 126/401 |
| 4,936,027 | A * | 6/1990 | Tsuji | A45D 1/04 132/228 |
| 5,467,540 | A | 11/1995 | Bastien | |
| 5,572,800 | A | 11/1996 | West | |
| 5,621,980 | A | 4/1997 | Kingsbury | |
| 5,649,370 | A | 7/1997 | Russo | |
| 5,738,121 | A | 4/1998 | Westerveld et al. | |
| 5,761,824 | A | 6/1998 | Moon et al. | |
| 5,765,292 | A | 6/1998 | Chan | |
| 5,841,943 | A * | 11/1998 | Nosenchuck | A45D 20/10 392/385 |
| 5,868,148 | A | 2/1999 | Lindsey et al. | |
| 5,954,064 | A | 9/1999 | Motherhead | |
| 5,956,863 | A | 9/1999 | Allen | |
| 6,011,903 | A | 1/2000 | Nosenchuck | |
| 6,085,435 | A | 7/2000 | Russi | |
| 6,227,846 | B1 * | 5/2001 | Zagoroff | B01F 5/0413 431/264 |
| 6,502,585 | B1 | 1/2003 | Mazzei et al. | |
| 6,532,968 | B1 | 3/2003 | Hafemann | |
| 6,922,909 | B2 | 8/2005 | Andrew et al. | |
| D598,532 | S | 8/2009 | Dyson et al. | |
| D602,143 | S | 10/2009 | Gammack et al. | |
| D602,144 | S | 10/2009 | Dyson et al. | |
| D605,748 | S | 12/2009 | Gammack et al. | |
| D614,280 | S | 4/2010 | Dyson et al. | |
| D643,098 | S | 8/2011 | Wallace et al. | |
| 8,091,564 | B2 | 1/2012 | Hafemann | |
| D672,023 | S | 12/2012 | Wallace et al. | |
| D672,024 | S | 12/2012 | Fitton et al. | |
| D715,995 | S | 10/2014 | Dyson et al. | |
| D715,996 | S | 10/2014 | Dyson et al. | |
| D716,492 | S | 10/2014 | Dyson et al. | |
| D728,092 | S | 4/2015 | Poulton et al. | |
| D728,769 | S | 5/2015 | Dyson et al. | |
| D728,770 | S | 5/2015 | Dyson et al. | |
| D729,372 | S | 5/2015 | McPherson et al. | |
| D729,373 | S | 5/2015 | Dos Reis et al. | |
| D729,374 | S | 5/2015 | Dos Reis et al. | |
| D729,375 | S | 5/2015 | Dos Reis et al. | |
| D729,376 | S | 5/2015 | McPherson et al. | |
| D729,447 | S | 5/2015 | Gammack | |
| D729,448 | S | 5/2015 | Gammack | |
| D729,925 | S | 5/2015 | McPherson et al. | |
| D729,978 | S | 5/2015 | Bates et al. | |
| D729,979 | S | 5/2015 | Gammack | |
| D730,575 | S | 5/2015 | Bates et al. | |
| D730,576 | S | 5/2015 | Gammack | |
| D731,117 | S | 6/2015 | Bates et al. | |
| 9,144,286 | B2 | 9/2015 | Courtney et al. | |
| D741,544 | S | 10/2015 | Gammack | |
| 9,173,468 | B2 | 11/2015 | Moloney et al. | |
| D746,425 | S | 12/2015 | Dyson et al. | |
| D746,966 | S | 1/2016 | Dyson et al. | |
| D747,450 | S | 1/2016 | Dyson et al. | |
| D749,231 | S | 2/2016 | Dyson et al. | |
| 9,282,799 | B2 * | 3/2016 | Courtney | A45D 20/12 |
| 9,282,800 | B2 | 3/2016 | Courtney et al. | |
| D757,361 | S | 5/2016 | Gammack | |
| D757,362 | S | 5/2016 | Dyson et al. | |
| D758,010 | S | 5/2016 | Bates et al. | |
| D758,011 | S | 5/2016 | Gammack | |
| D758,012 | S | 5/2016 | Bates et al. | |
| 9,326,591 | B2 | 5/2016 | Nicoline | |
| 9,526,310 | B2 * | 12/2016 | Courtney | A45D 20/00 |
| 9,681,726 | B2 * | 6/2017 | Moloney | A45D 20/10 |
| 9,808,067 | B2 * | 11/2017 | Sutter | A45D 20/10 |
| 10,064,469 | B2 * | 9/2018 | Quessard | A45D 20/10 |
| 2002/0078587 | A1 | 6/2002 | White | |
| 2004/0163274 | A1 | 8/2004 | Andrew et al. | |
| 2009/0064529 | A1 | 3/2009 | Kang | |
| 2013/0111777 | A1 | 5/2013 | Jeong | |
| 2013/0232809 | A1 | 9/2013 | Vasquez | |
| 2013/0269200 | A1 | 10/2013 | Moloney et al. | |
| 2013/0276320 | A1 | 10/2013 | Courtney et al. | |
| 2013/0283630 | A1 | 10/2013 | Courtney et al. | |
| 2014/0007448 | A1 | 1/2014 | Courtney | |
| 2014/0007449 | A1 * | 1/2014 | Courtney | A45D 20/122 34/97 |
| 2015/0007442 | A1 | 1/2015 | Gammack et al. | |
| 2015/0007443 | A1 | 1/2015 | Gammack et al. | |
| 2015/0007444 | A1 | 1/2015 | Moloney et al. | |
| 2015/0007854 | A1 | 1/2015 | Moloney et al. | |
| 2015/0007855 | A1 | 1/2015 | Moloney et al. | |
| 2015/0026993 | A1 * | 1/2015 | Sutter | A45D 20/10 34/96 |
| 2015/0082652 | A1 | 3/2015 | Atkinson | |
| 2015/0089828 | A1 | 4/2015 | Moloney et al. | |
| 2015/0093099 | A1 * | 4/2015 | Shelton | A45D 20/12 392/380 |
| 2015/0157106 | A1 | 6/2015 | Atkinson | |
| 2015/0157107 | A1 | 6/2015 | Gosnay et al. | |
| 2016/0000201 | A1 | 1/2016 | Doran | |
| 2016/0022004 | A1 | 1/2016 | Johnson | |
| 2016/0120286 | A1 | 5/2016 | Han | |
| 2016/0143409 | A1 | 5/2016 | Moloney et al. | |
| 2016/0166033 | A1 | 6/2016 | Kerr et al. | |
| 2016/0166035 | A1 | 6/2016 | Douglas et al. | |
| 2016/0206075 | A1 | 7/2016 | Stephens et al. | |
| 2016/0206076 | A1 | 7/2016 | Stephens et al. | |
| 2016/0206077 | A1 | 7/2016 | Stephens et al. | |
| 2016/0230777 | A1 * | 8/2016 | Dao | A61F 7/0085 |
| 2016/0235178 | A1 | 8/2016 | Atkinson et al. | |

FOREIGN PATENT DOCUMENTS

| | | | |
|---|---|---|---|
| EP | 1034719 | A1 | 9/2000 |
| EP | 1123019 | B1 | 4/2003 |
| EP | 940101 | B1 | 9/2003 |
| EP | 1222871 | B1 | 9/2004 |
| EP | 2198740 | B1 | 11/2011 |
| EP | 2462831 | A2 | 6/2012 |
| EP | 2736374 | A1 | 6/2014 |
| EP | 2740383 | A2 | 6/2014 |
| EP | 2830458 | A1 | 2/2015 |
| EP | 2830459 | A1 | 2/2015 |
| EP | 2830460 | A1 | 2/2015 |
| EP | 2830461 | A1 | 2/2015 |
| EP | 2830462 | A1 | 2/2015 |
| EP | 2830463 | A1 | 2/2015 |
| EP | 2869726 | A1 | 5/2015 |
| EP | 3016539 | A1 | 5/2016 |
| EP | 3016540 | A1 | 5/2016 |
| EP | 3016541 | A1 | 5/2016 |
| EP | 3016542 | A1 | 5/2016 |
| EP | 3016544 | A1 | 5/2016 |
| EP | 3016545 | A1 | 5/2016 |
| EP | 3024352 | A1 | 6/2016 |
| EP | 2823726 | B1 | 8/2016 |
| GB | 1217069 | A | 12/1970 |
| GB | 2503684 | A | 1/2014 |
| GB | 2539441 | B | 12/2016 |
| RU | 2127993 | C1 | 3/1999 |
| RU | 2506024 | C2 | 2/2014 |
| WO | 1994023611 | A1 | 10/1994 |
| WO | 2001015568 | A1 | 3/2001 |
| WO | 2012172294 | A1 | 12/2012 |
| WO | 2013014093 | A1 | 1/2013 |
| WO | 2013144573 | A1 | 10/2013 |
| WO | 2014006365 | A1 | 1/2014 |
| WO | 2015001309 | A1 | 1/2015 |
| WO | 2015011442 | A1 | 1/2015 |
| WO | 2015028632 | A1 | 3/2015 |
| WO | 2015044646 | A1 | 4/2015 |
| WO | 2015087040 | A1 | 6/2015 |
| WO | 2015150720 | A1 | 10/2015 |
| WO | 2016108018 | A1 | 7/2016 |
| WO | 2016116728 | A1 | 7/2016 |
| WO | 2016116729 | A1 | 7/2016 |
| WO | 2016116730 | A1 | 7/2016 |

(56) References Cited

FOREIGN PATENT DOCUMENTS

OTHER PUBLICATIONS

Third Party Observation re European Patent Application No. 18183225.4 dated Oct. 28, 2020; pp. 5.
Office Action issued by the European Patent Office for European patent application No. 18 183 225.4-1002, dated Jul. 30, 2021, 6 pages.
China First Office Action for CN Patent Application 201810749201.X dated Jan. 8, 2021; 5 pp.

* cited by examiner

AIR-MOVING APPLIANCE INCLUDING AN ATTACHMENT

CROSS-REFERENCE TO RELATED APPLICATION

This application is a continuation application of U.S. patent application Ser. No. 15/650,606, filed on Jul. 14, 2017, which is incorporated herein in its entirety.

FIELD OF THE DISCLOSURE

The present disclosure relates generally to an air-moving appliance, and more particularly to an air-moving appliance including an attachment.

BACKGROUND OF THE DISCLOSURE

Most air-moving appliances include an airflow duct that extends between an inlet and an outlet. During operation, airflow is directed through the air-moving appliance from the inlet to the outlet. Sometimes, an attachment may be connected to the air-moving appliance to channel airflow into the inlet or out of the outlet. However, the attachments may be difficult for a user to connect to the air-moving appliances. For example, some attachments may need to be positioned in a particular orientation to engage the air-moving appliance. Moreover, some attachments may not be compatible with different air-moving appliances.

Accordingly, it is desirable to provide an attachment for an air-moving appliance that is simple to connect and disconnect from air-moving appliances.

SUMMARY

In one aspect, an air-moving appliance includes a body extending about an axis. The body includes an inner wall and an outer wall spaced radially outward from the inner wall. The inner wall and the outer wall define a cavity therebetween. The inner wall defines a central passage. The air-moving appliance also includes an inlet for airflow to enter the cavity defined by at least one of the inner wall and the outer wall and an outlet for the airflow to exit the cavity. The outlet is circumferentially outward of the central passage. The air-moving appliance further includes an attachment configured to selectively connect to the body in flow communication with the outlet. The attachment includes a connector configured to extend into the central passage defined by the inner wall of the body. The connector has a shape that corresponds to the shape of the central passage. The attachment also includes an attachment inlet configured to receive the airflow that exits the cavity of the body through the outlet. The attachment inlet is circumferentially disposed about the axis and the central passage defined by the inner wall of the body when the attachment is connected to the body.

In another aspect, an attachment for an air-moving appliance includes a first end configured to selectively connect to a body of the air-moving appliance and a second end spaced from the first end. The attachment also includes a body defining a passage for airflow between the first end and the second end, and a connector configured to extend into a central passage defined by the body of the air-moving appliance and connect the first end of the attachment to the body of the air-moving appliance. The connector includes a wall having a shape that corresponds to the shape of the central passage and a collar that extends about the wall. The collar and the wall define an annular inlet configured to receive airflow from an outlet of the air-moving appliance.

In yet another aspect, an attachment kit for an air-moving appliance includes a first attachment (such as attachment 300 shown in FIG. 13) and a second attachment (such as attachment 400 shown in FIG. 17). The attachment kit also includes a connector configured to extend into a central passage of the air-moving appliance. The connector is configured to connect at least one of the first attachment and the second attachment to the air-moving appliance. The connector includes a cylindrical wall having a shape that corresponds to a shape of the central passage. The cylindrical wall is configured to extend into the central passage. The connector also includes a collar extending about and spaced radially from the cylindrical wall. The collar and the cylindrical wall define an annular inlet therebetween configured to receive airflow from the air-moving appliance.

BRIEF DESCRIPTION OF THE DRAWINGS

Corresponding reference characters indicate corresponding parts throughout the drawings.

DETAILED DESCRIPTION OF THE DRAWINGS

Figure 1:
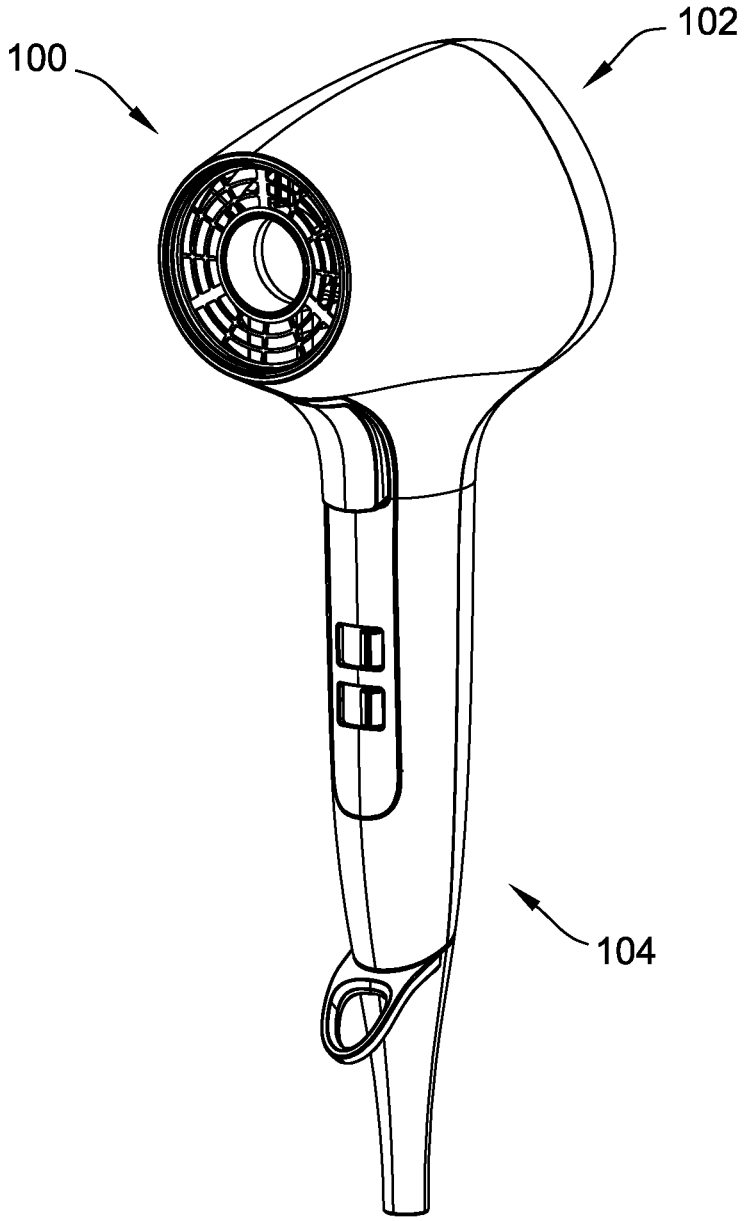
FIG. 1 is a perspective view of a first embodiment of an air-moving appliance.
Figure 2:
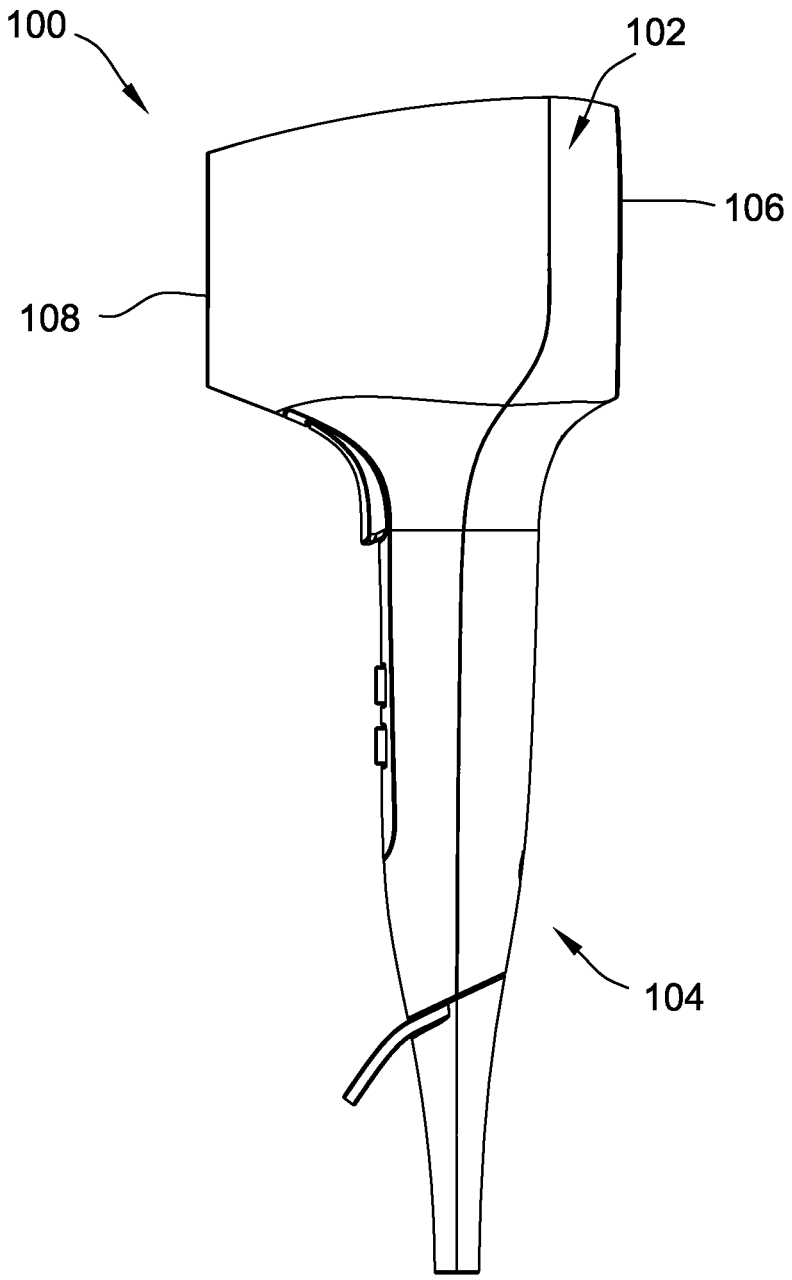
FIG. 2 is a right elevational view of the air-moving appliance of FIG. 1.
Figure 3:
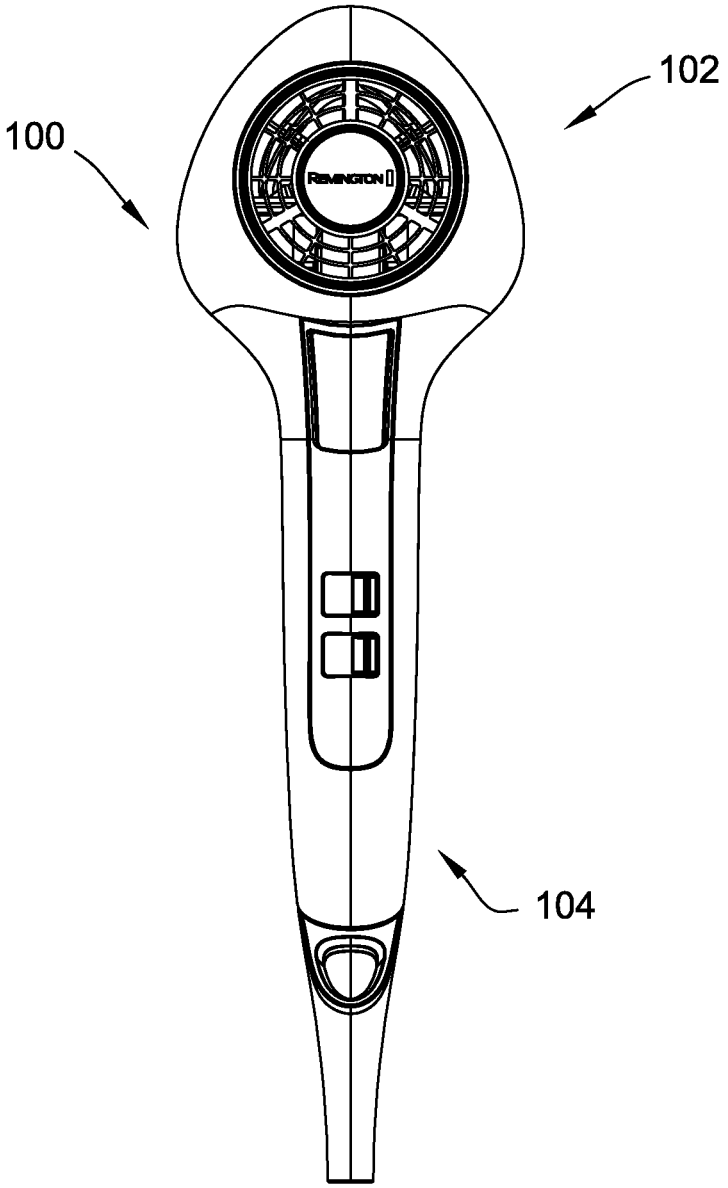
FIG. 3 is a front elevational view of the air-moving appliance of FIG. 1.
Figure 4:
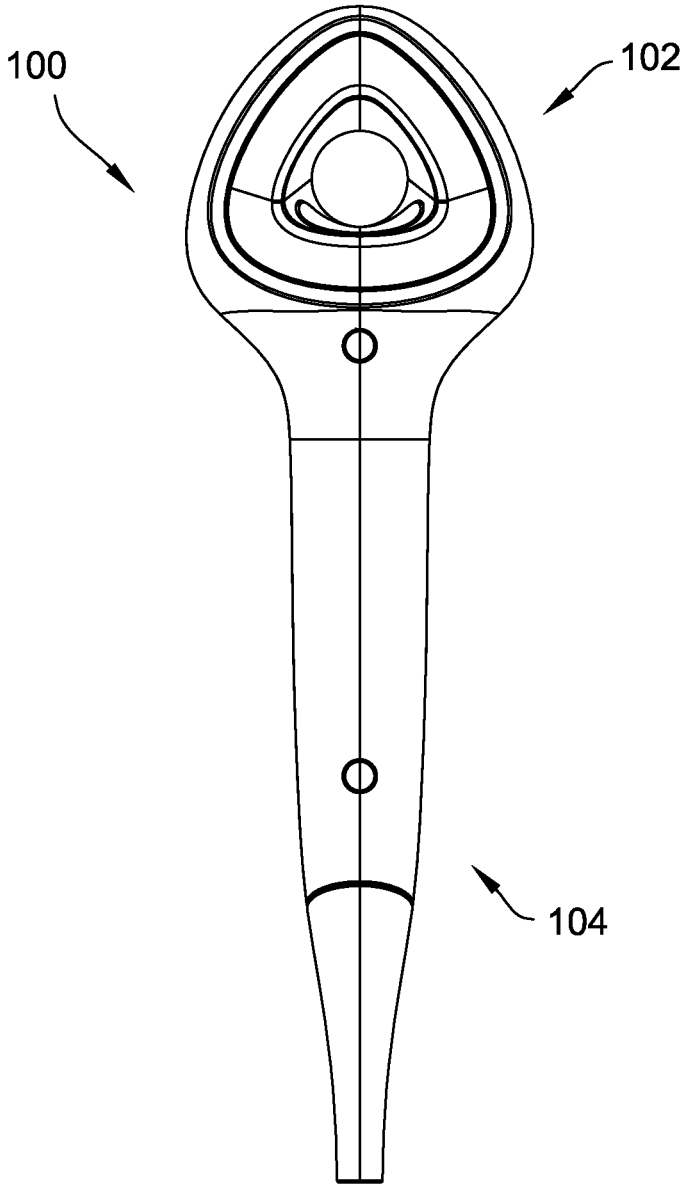
FIG. 4 is a rear elevational view of the air-moving appliance of FIG. 1.

Referring to the drawings, and in particular to FIGS. 1-7, one embodiment of a hair dryer, broadly an air-moving appliance, is generally indicated at 100. The hair dryer 100 includes a body 102 and a handle 104. In general, the hair dryer 100 is adapted to direct heated air to hair to remove moisture from the hair. In some embodiments, the hair dryer 100 may include a user interface to enable a user to control the hair dryer 100. Suitable user interfaces include, for example and without limitation, screens, buttons, knobs, levers, and/or switches. The hair dryer 100 may have other suitable configurations without departing from the scope of this invention.

As shown in FIGS. 1-4, the handle 104 extends downward from the body 102 and is configured to be held by a user during operation of the hair dryer 100. Accordingly, the hair dryer 100 is handheld. In the illustrated embodiment, the body 102 and the handle 104 are connected together to form a single housing assembly. In other embodiments, the hair dryer 100 may include other handles without departing from the scope of this invention.

Figure 5:
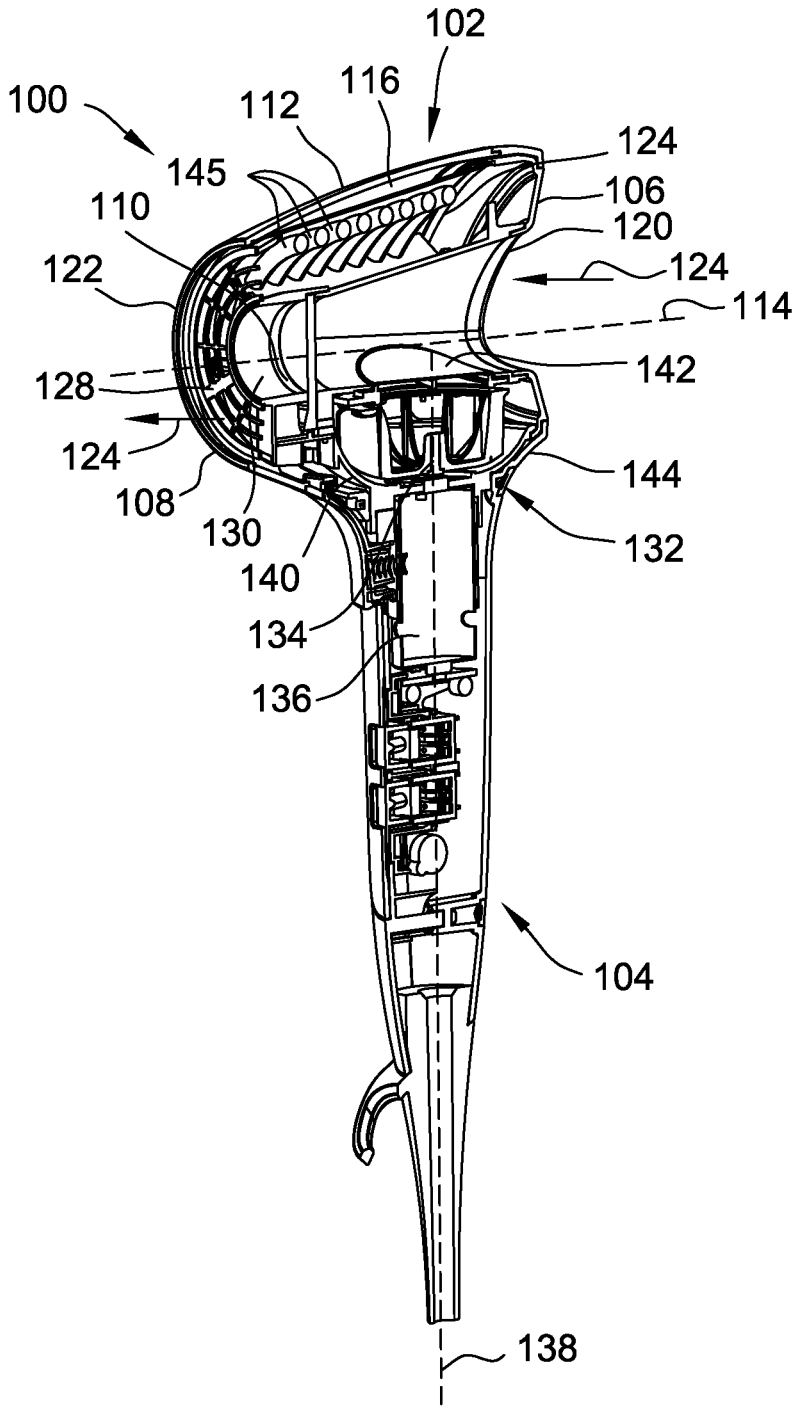
FIG. 5 is a schematic sectional view of the air-moving appliance of FIG. 1 showing airflow through the air-moving appliance.

In reference to FIG. 5, in the illustrated embodiment, the body 102 includes a first (or rear) end 106, a second (or front) end 108, an inner wall 110, and an outer wall 112. The inner wall 110 and the outer wall 112 extend from the first end 106 to the second end 108 about a central axis 114. In addition, the outer wall 112 is spaced radially outward from the inner wall 110 such that the outer wall 112 and the inner wall 110 cooperatively define a cavity 116 therebetween. In the illustrated embodiment, the outer wall 112 and the inner wall 110 are generally cylindrical and the outer wall 112 circumscribes the inner wall 110. Accordingly, the body 102 and the cavity 116 have an annular shape. In addition, in the illustrated embodiment, the outer wall 112 has a decreasing diameter between the first end 106 and the second end 108 such that the body 102 tapers between the first end 106 and the second end 108. In alternative embodiments, the hair dryer 100 may include any body 102 that enables the hair dryer 100 to operate as described herein.

The inner wall 110 defines an inlet 120 for airflow 124 to enter the cavity 116 at a location intermediate the first end 106 and the second end 108. In addition, the inner wall 110 and the outer wall 112 define an outlet 122 for the airflow 124 to exit the cavity 116. The outlet 122 is located at the second end 108. During operation, the hair dryer 100 draws the airflow 124 into the inlet 120, directs the airflow 124 through the cavity 116, and discharges the airflow 124 through the outlet 122. The hair dryer 100 includes a grill 128 extending across the outlet 122 to prevent objects passing through the outlet 122. In the illustrated embodiment, the inlet 120 is circular and the outlet 122 is annular. The hair dryer 100 may include other inlets and/or outlets without departing from some aspects of the invention.

In the illustrated embodiment, the inner wall 110 defines a central passage 130 extending from the first end 106 to the second end 108 along the central axis 114. Airflow 124 travels through the central passage 130 along the central axis 114. The inlet 120 is located intermediate the first end 106 and the second end 108 and is in flow communication with the central passage 130. Accordingly, the inlet 120 allows the airflow 124 through the central passage 130 to be drawn into the cavity 116. In other embodiments, the hair dryer 100 may include other central passages 130 without departing from some aspects of the invention. For example, in some embodiments, the central passage 130 may extend from the first end 106 to the inlet 120 and may not necessarily extend continuously to the second end 108.

The inner wall 110 and the outer wall 112 are connected at the first end 106 such that the cavity 116 is sealed at the first end 106. The inner wall 110 and the outer wall 112 may be connected in any suitable manner. For example, in some embodiments, the inner wall 110 and the outer wall 112 are integrally formed. In further embodiments, the inner wall 110 and the outer wall 112 are formed separately and are fastened together.

The hair dryer 100 may receive power from any suitable power source. For example, in some embodiments, the hair dryer 100 may include a power cord that connects to an external power source. In further embodiments, the hair dryer may be at least partially powered by an internal power source such as a battery.

In reference to FIGS. 6-9, a fan 132 is positioned in the body 102 adjacent the inlet 120. The fan 132 is connected to a drive shaft 134 operatively connected to a motor 136. The motor 136, in the illustrated embodiment, is located in the handle 104. The fan 132 is located in the body 102 above the handle 104 such that the fan 132 and the motor 136 have a stacked configuration. Moreover, the motor 136 and the fan 132 are oriented in a direction substantially perpendicular to the central axis 114. As a result, the motor 136 and the fan 132 allow the hair dryer 100 to have a reduced size. In particular, the size of the body 102 may be reduced because the motor 136 is positioned in the handle 104 and the fan 132 is offset from components such as heating units in the body 102. In addition, the hair dryer 100 may be easier for a user to position because the motor 136 and the fan 132 are aligned with the handle 104. In other embodiments, the motor 136 and/or the fan 132 may be at least partially located in the handle 104 and/or the body 102.

During operation, the motor 136 is configured to rotate the fan 132 about a rotation axis 138. The rotation axis 138 is perpendicular to the central axis 114. When the motor 136 rotates the fan 132, the fan 132 is configured to draw the airflow 124 into the inlet 120 and direct the airflow 124 through the cavity 116. The inner wall 110 and the outer wall 112 direct the airflow 124 through the cavity 116 and towards the outlet 122. In addition, the body 102 is configured to distribute the airflow 124 evenly throughout the cavity 116 prior to discharge through the outlet 122. As shown in FIG. 5, the airflow 124 is directed around the inner wall 110 and throughout the annular cavity 116.

As shown in FIG. 5, the inner wall 110 defines an inlet 120. In the illustrated embodiment, the inlet 120 has a diameter or width that is substantially equal to the width of the central passage 130 and facilitates the airflow 124 from the central passage 130 being drawn into the cavity 116. An interface 142 extends across the inlet 120. The interface 142 includes a plurality of openings and is configured to direct the airflow 124 into the cavity 116. In particular, the interface 142 directs the airflow 124 towards the center of the fan 132 in a direction parallel to the rotation axis 138. In this embodiment, the interface 142 is formed separately from the inner wall 110 and is coupled to the inner wall 110. In other embodiments, the interface 142 may be integrally formed with the inner wall 110. In some embodiments, the interface 142 may include a mesh or screen to prevent objects entrained in the airflow 124 from entering the cavity 116 and possibly damaging the fan 132.

A bottom portion 144 of the outer wall 112 adjacent the handle 104 is substantially concave and provides a transition from the cylindrical shape of the handle 104 to the annular shape of the body 102. In addition, the interior of the bottom portion 144 directs the airflow 124 generally upward such that the airflow 124 is uniformly distributed throughout the cavity 116 prior to discharge through the outlet 122.

One or more heating units 145 may be positioned within the cavity 116. The heating units 145 may be configured to increase the temperature of the airflow 124 prior to the airflow 124 being discharged through the outlet 122. In suitable embodiments, the heating units 145 may have a power rating of about 1,000 watts to about 2,600 watts.

In addition, the fan 132 and the motor 136 are configured to discharge the airflow 124 at a desired rate. For example, the hair dryer 100 may be configured to discharge the airflow 124 at a rate in a range of about 30 cubic feet per minute to about 75 cubic feet per minute.

The hair dryer 100 may have any operating setting that enables the hair dryer to operate as described herein. For example, the motor 136 may have two or more operating speeds. In addition, the hair dryer 100 may include different temperature settings. For example, in some embodiments, the hair dryer 100 may include a heating unit including two or more different temperatures settings. Moreover, the hair dryer 100 may be configured to deliver airflow 124 having a temperature at or below the temperature of the ambient environment, i.e., a cool stream.

Also, the hair dryer 100 may include attachments such as a concentrator, a diffuser, a pick, a nozzle, a straightener, and any other suitable attachments. The attachments may be configured to attach to the second end 108 of the body 102 adjacent the outlet 122. Accordingly, at least a portion of the attachments may be annular in shape. The attachments may be connected to the body 102 in any manner that enables the hair dryer 100 to operate as described herein.

Figure 6:
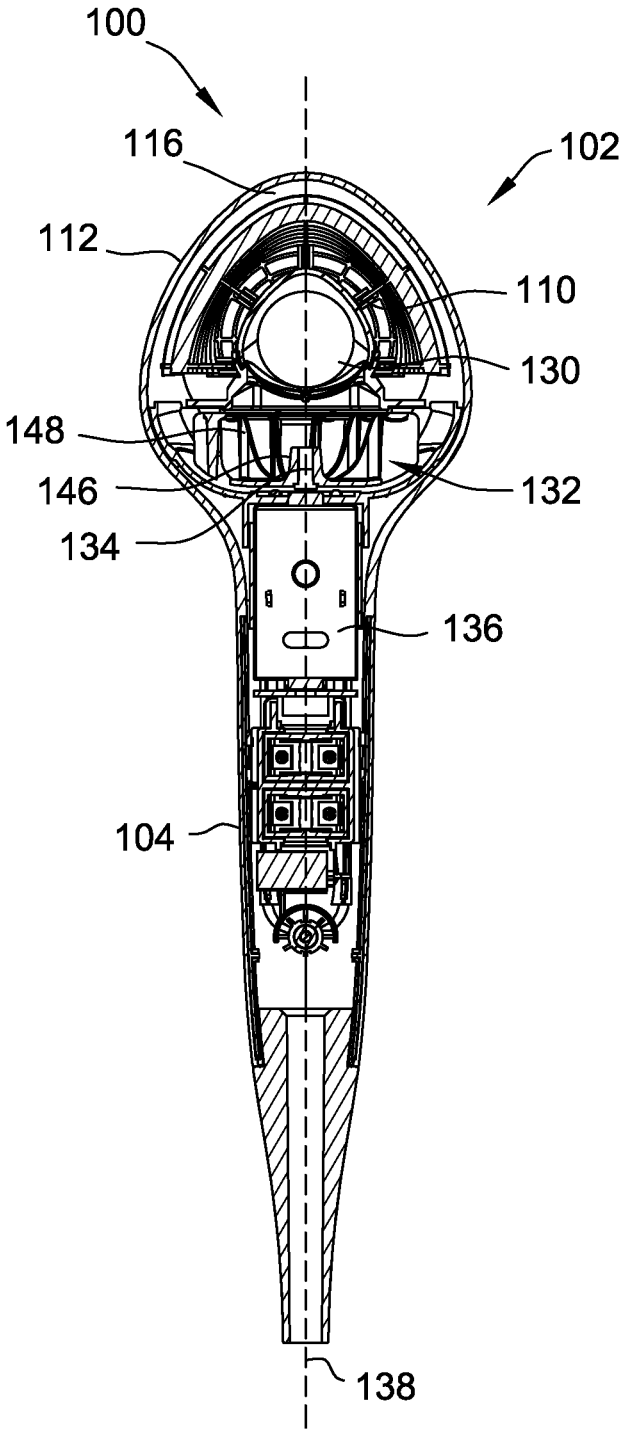
FIG. 6 is a rear sectional view of the air-moving appliance of FIG. 1.
Figure 7:
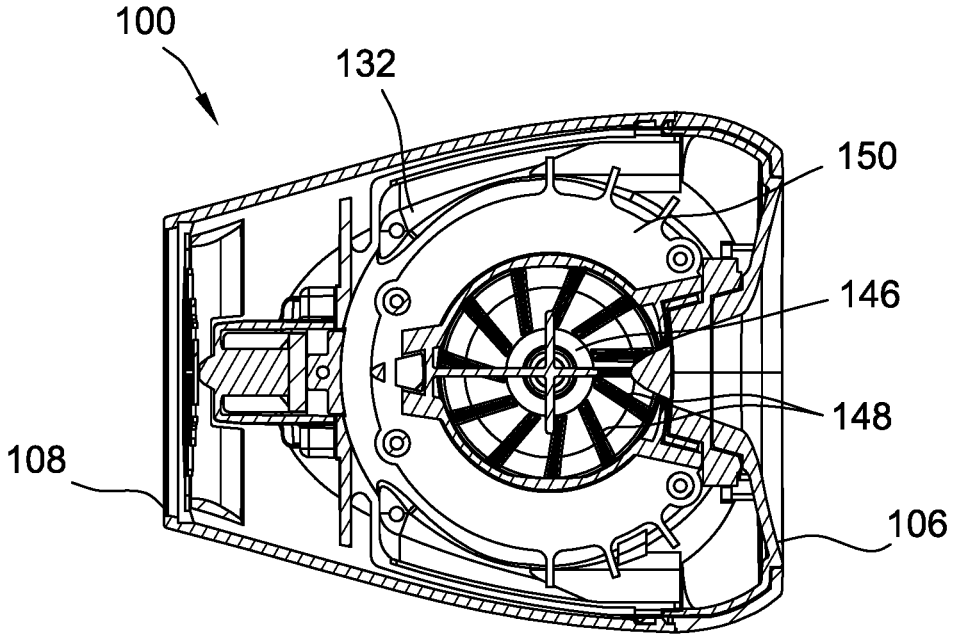
FIG. 7 is a top sectional view of the air-moving appliance of FIG. 1.

In reference to FIGS. 5-7, the fan 132 includes a hub 146 and a plurality of blades 148. The blades 148 extend upward from the hub 146 and radially outward from the rotation axis 138. Accordingly, the fan 132 is configured to turn or redirect the airflow 124 in a direction that is different from the direction of the airflow 124 entering the fan 132. Specifically, in the illustrated embodiment, the fan 132 is a radial fan and the airflow 124 is directed in a radial direction relative to the rotation axis 138. The fan 132 may have other suitable configurations without departing from some aspects of the invention.

In reference to FIGS. 5 and 7, a center of the hub 146 of the fan 132 is connected to the drive shaft 134 such that the rotation axis 138 of the fan 132 is substantially perpendicular to the central axis 114. During operation, the fan 132 is configured to rotate about the rotation axis 138 to draw the airflow 124 into the cavity 116 through the inlet 120. The airflow 124 is drawn towards the center of the fan 132 in a direction substantially parallel to the rotation axis 138. The blades 148 direct the airflow 124 radially outward. A shroud or bowl 140 extending around the fan 132 redirects the airflow 124 in a direction opposite the direction of the airflow 124 entering the fan 132 such that the airflow 124 is discharged into the cavity 116 in a direction parallel to the rotation axis 138 and spaced radially from the rotation axis 138. Accordingly, the airflow 124 is directed into the cavity 116 around the exterior of the inlet 120. The fan 132 and the bowl 140 facilitate the airflow 124 flowing around the inlet 120 and being distributed throughout the cavity 116.

Figure 8:
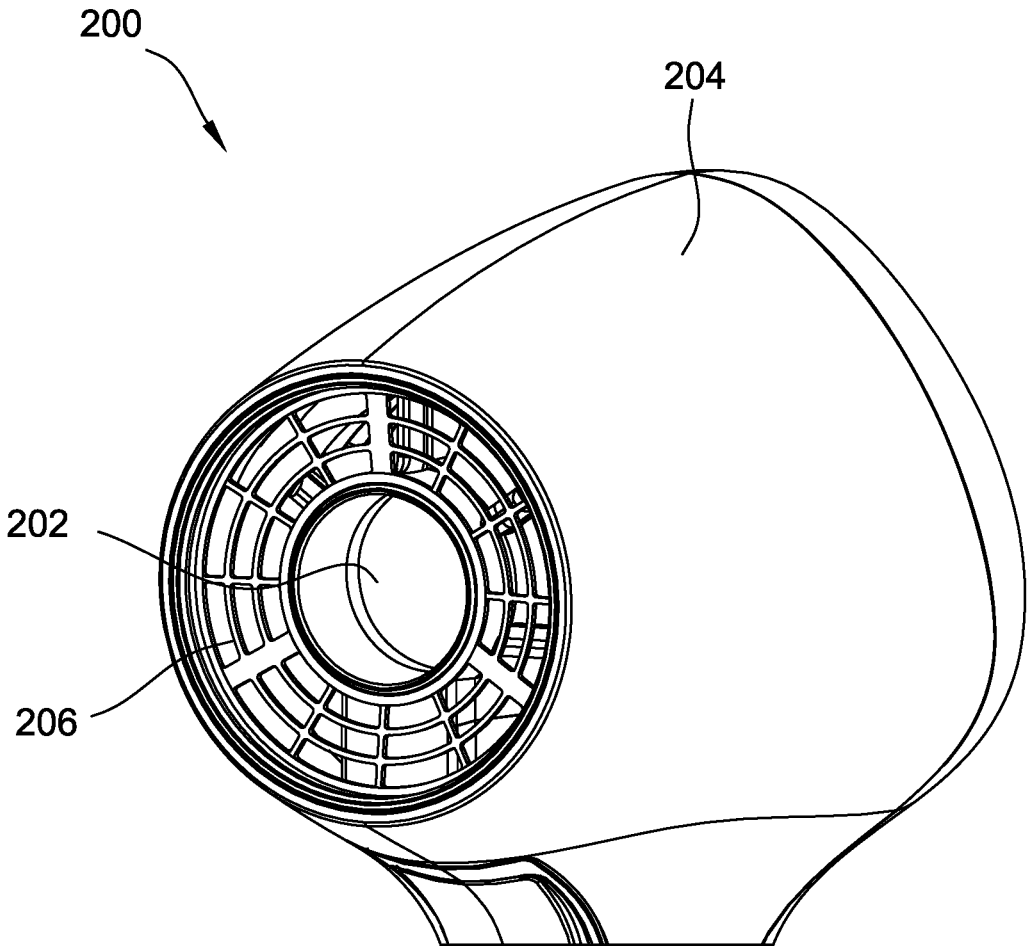
FIG. 8 is an enlarged perspective view of a portion of a second embodiment of an air-moving appliance.
Figure 9:
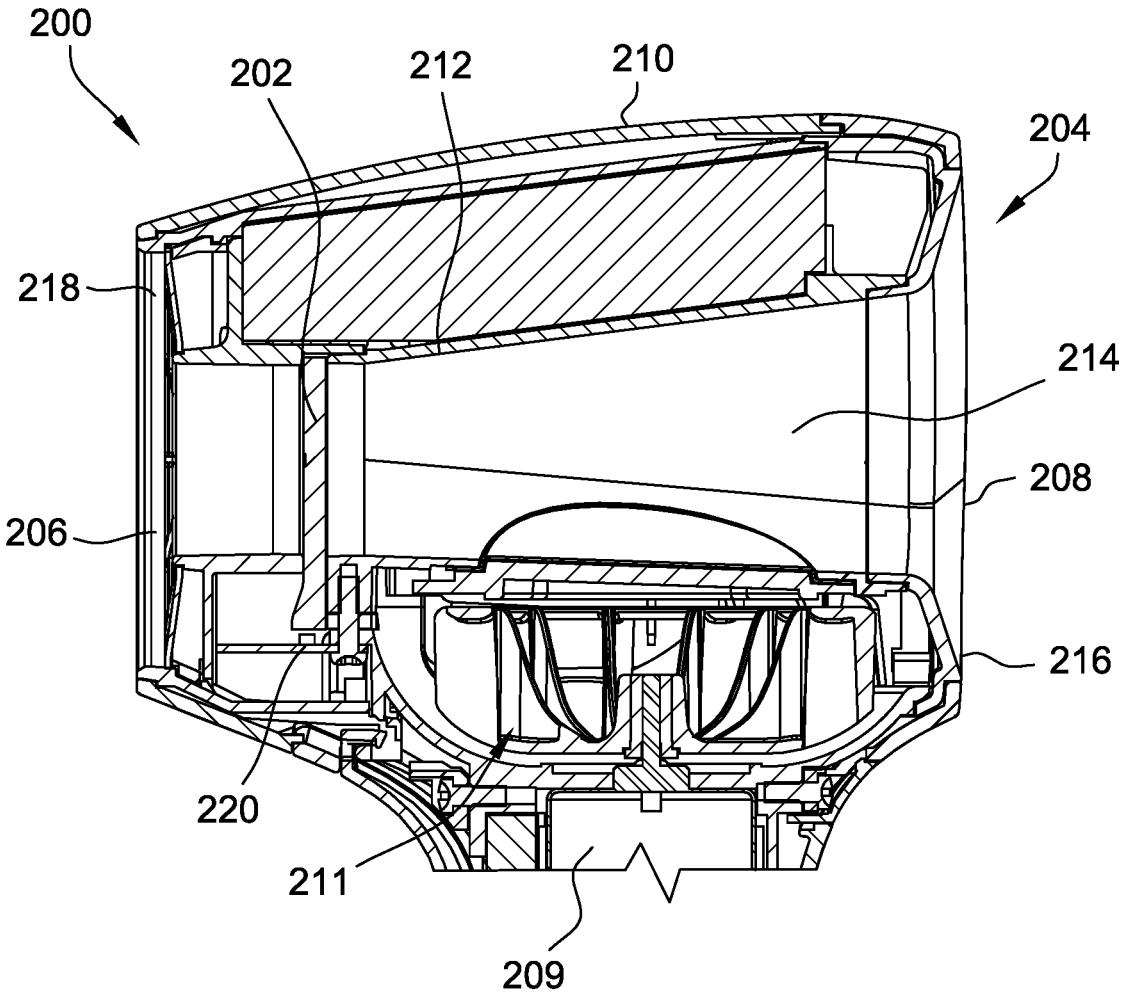
FIG. 9 is schematic sectional view of the air-moving appliance of FIG. 8.

Referring now to FIGS. 8 and 9, a second embodiment of a hair dryer is generally indicated at 200. The hair dryer 200 is substantially similar to the hair dryer 100 except the hair dryer 200 includes a shield 202. The hair dryer 200 includes shield 202, a body 204, a grill 206, a handle 208, a motor 209, and a fan 211. The body 204 includes an outer wall 210 and an inner wall 212. The inner wall 212 defines a central passage 214. An inlet 216 is defined by the inner wall 212 and an outlet 218 is defined between the outer wall 210 and the inner wall 212. The grill 206 is attached to the outer wall 210 and extends across the outlet 218.

As shown in FIG. 9, the shield 202 is coupled to the inner wall 212 and extends across the central passage 214. The shield 202 is located intermediate the ends of the inner wall 212. Accordingly, the shield 202 directs airflow in the central passage 214 towards an inlet 216. In addition, the shield 202 reduces recirculation of airflow that is discharged through the outlet 218. As a result, the shield 202 increases the operating efficiency of the hair dryer 200. In some embodiments, the shield 202 may be at least partially transparent or translucent. In further embodiments, the shield 202 may include a logo and/or a product identifier. Moreover, in some embodiments, the shield 202 may facilitate connecting attachments to the second end 108. In other embodiments, the hair dryer 200 may include other shields without departing from some aspects of the invention.

In the illustrated embodiment, the hair dryer 200 includes a light 220 positioned below the shield 202 and attached to the inner wall 212. For example, the light 220 may be mounted to a printed circuit board assembly (PCBA) attached to the inner wall 212. The light 220 is configured to direct light into the central passage 214 and at least partially illuminate the shield 202. In some embodiments, the light 220 is configured to change color based on an operational status of the hair dryer 200. Accordingly, the light 220 may increase the aesthetic appeal of the hair dryer 100 and allow the user to quickly determine information about the hair dryer 200. For example, in some embodiments, the light 220 may change from a first color, e.g., red, when the hair dryer 200 provides heated air to a second color, e.g., blue, when the hair dryer 200 provides airflow at or below the ambient temperature.

Figure 10:
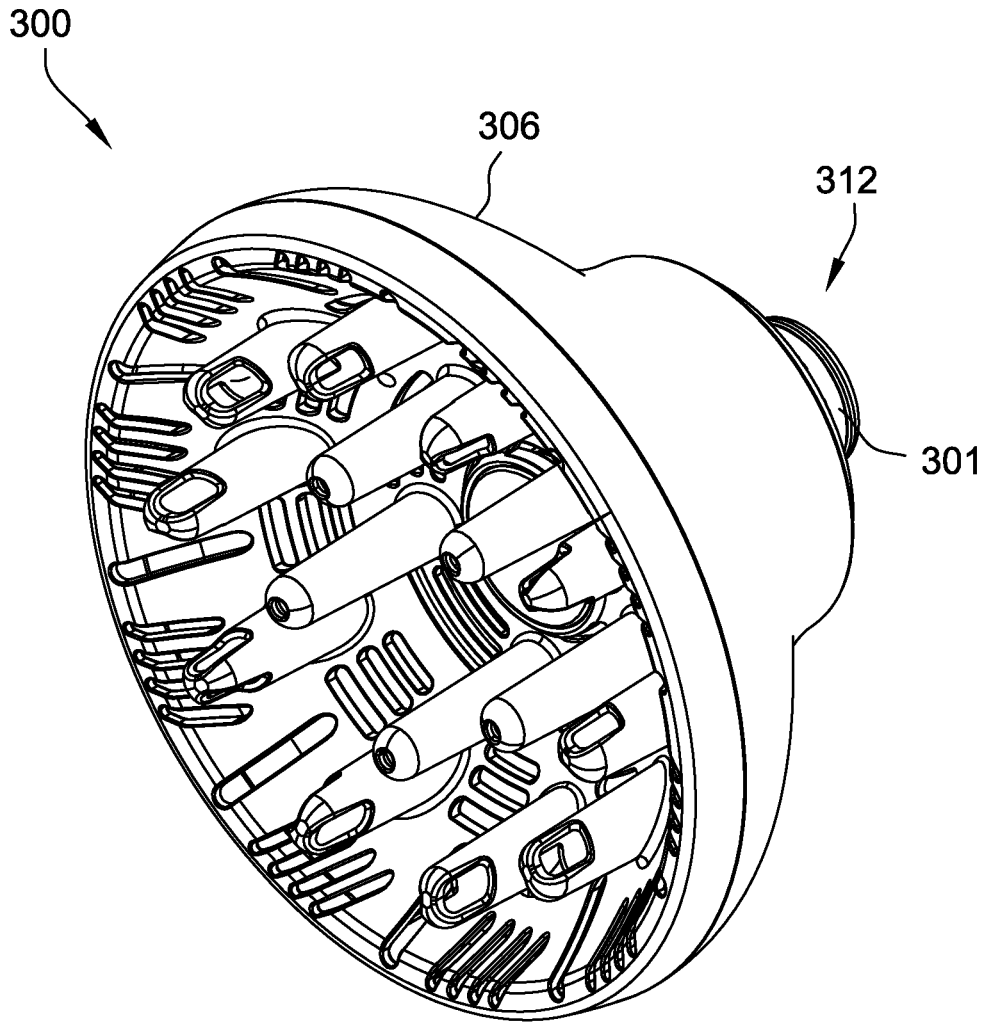
FIG. 10 is a perspective view of a diffuser attachment for use with the air-moving appliances shown in FIGS. 1 and 8.

FIG. 10 is a perspective view of a diffuser attachment 300 for use with air moving appliances such as the hair dryer 100 (shown in FIG. 1) and the hair dryer 200 (shown in FIG. 8). In reference to FIGS. 10-13, the diffuser attachment 300 includes a first end 302, a second end 304, a body 306, an inlet 308, outlets 310, and a connector 312. A grip feature 301 is configured to removably connect the first end 302 to the air-moving appliances such that the diffuser attachment 300 at least partially covers one of an inlet and an outlet of the air-moving appliances. The grip feature 301 facilitates the user connecting and disconnecting the diffuser attachment 300 and the air-moving appliance as described herein.

In the illustrated embodiment, the inlet 308 is substantially annular and extends about the connector 312. The outlets 310 are spaced throughout the second end 304. Each outlet 310 is an elongate slot. At least some outlets 310 are different sizes. In other embodiments, the diffuser attachment 300 may include other inlets 308 and outlets 310 without departing from some aspects of the invention. For example, in some embodiments, the diffuser attachment 300 may include a single outlet 310.

Figure 11:
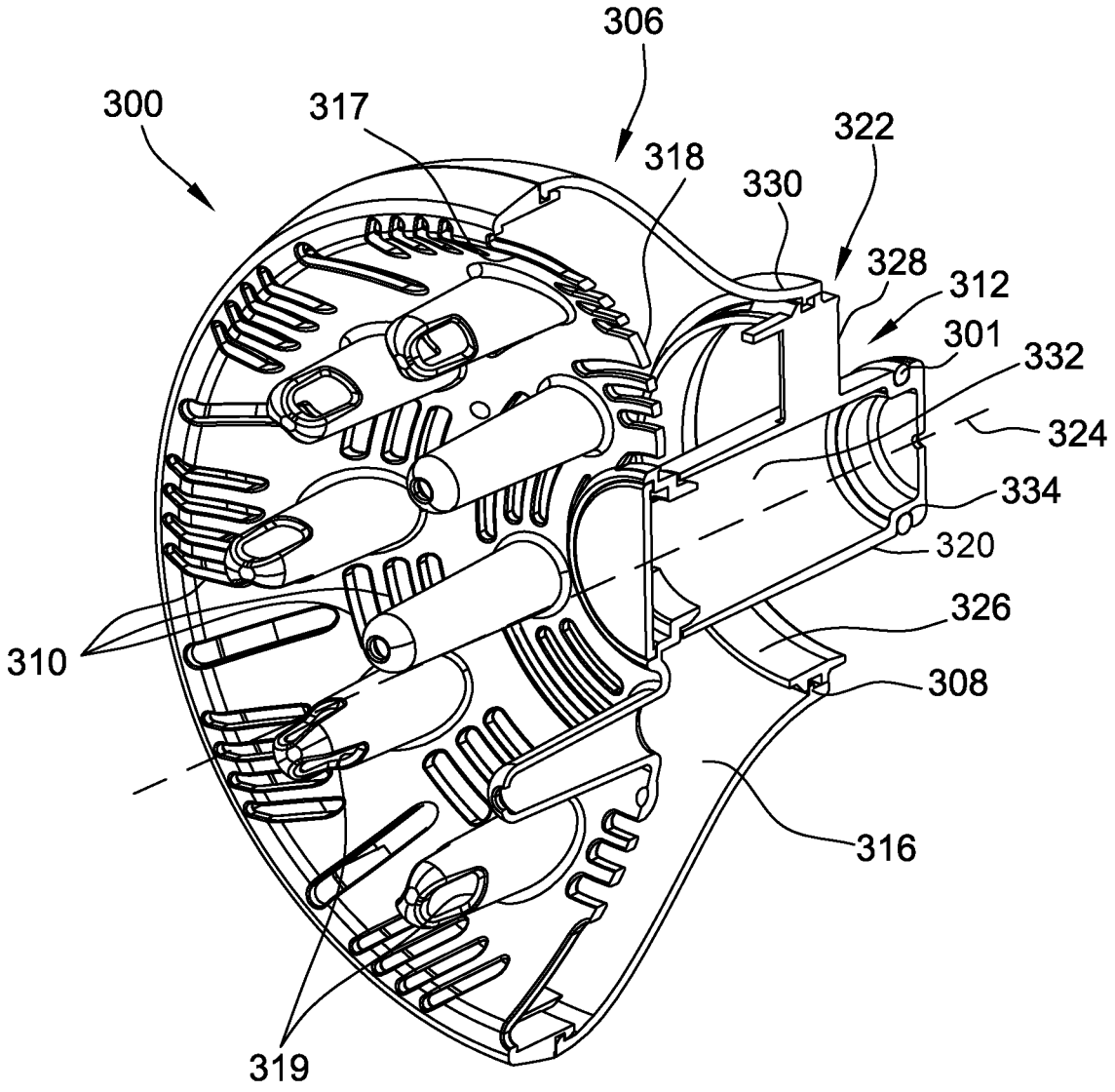
FIG. 11 is a sectional view of the diffuser attachment shown in FIG. 10.
Figure 12:
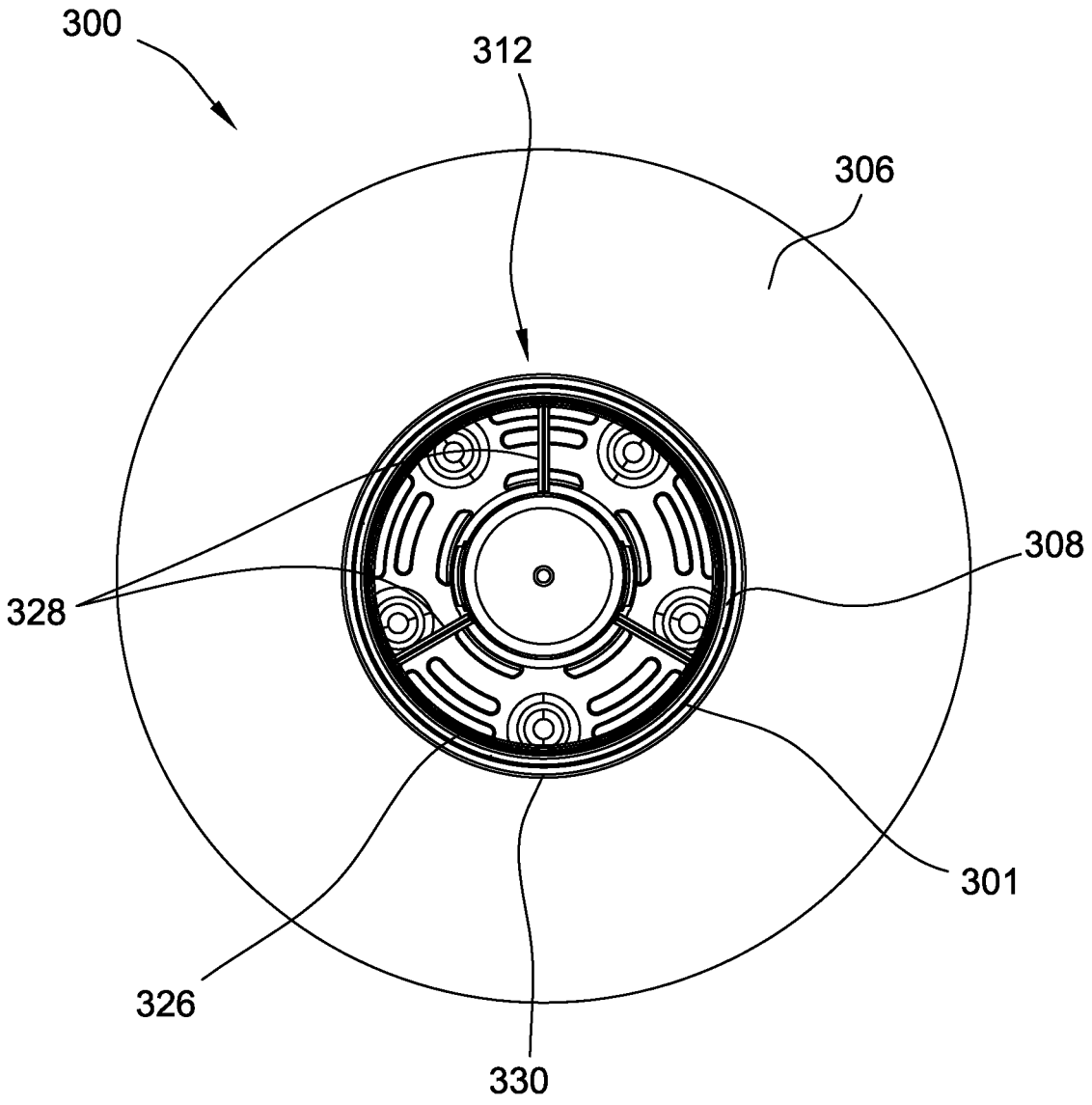
FIG. 12 is a rear view of the diffuser attachment shown in FIG. 10.

As shown in FIG. 11, the body 306 defines a passage 316 extending from the inlet 308 to the outlet 310. The body 306 includes a concave surface 317 on the exterior of the diffuser attachment 300 and a convex surface 318 on the interior of the diffuser attachment. During operation, the body 306 directs airflow from inlet 308 through the passage 316 along the convex surface 318 of the second end 304 and towards the outlets 310. The body 306 has an increasing width from the inlet 308 to the outlet 310. The diffuser attachment 300 is configured to receive an airflow through the inlet 308 and discharge the airflow through the outlets 310 in a distributed manner, i.e., diffuse the airflow. In addition, prongs 319 extend from the concave surface and are configured to engage objects, such as hair, during operation of the air-moving appliance. In other embodiments, the diffuser attachment 300 may have any configuration that enables the diffuser attachment to operate as described herein.

In the illustrated embodiment, the connector 312 includes a wall 320 and a stop 322. The wall 320 extends along an axis 324 and forms an elongate cylinder. The stop 322 is disposed intermediate the first end 302 and the second end 304 and includes a collar 326 and braces 328. The collar 326 extends about and is spaced radially from the wall 320. The braces 328 extend radially from the wall 320 to the collar 326. In other embodiments, the diffuser attachment 300 may include any connector 312 that enables the diffuser attachment 300 to operate as described herein. In some embodiments, the connector 312 may be omitted without departing from some aspects of the invention.

The connector 312 extends partially along a central axis of the body 306 such that airflow 124 into the inlet 308 passes between the collar 326 and the wall 320. The wall 320 defines a hollow inner space 332 that is sealed from the passage 316. In the illustrated embodiment, the body 306 and the connector 312 are connected to form a single assembly. In particular, the collar 326 is configured to engage a rim 330 of the body 306 and the wall 320 is configured to engage the convex surface 318 of the body 306. In some embodiments, the body 306 and the connector 312 may be removably connected. In other embodiments, the body 306 and the connector 312 may be connected in any manner that enables the diffuser attachment 300 to operate as described herein. For example, in some embodiments, the body 306 and the connector 312 may be integrally formed.

Figure 13:
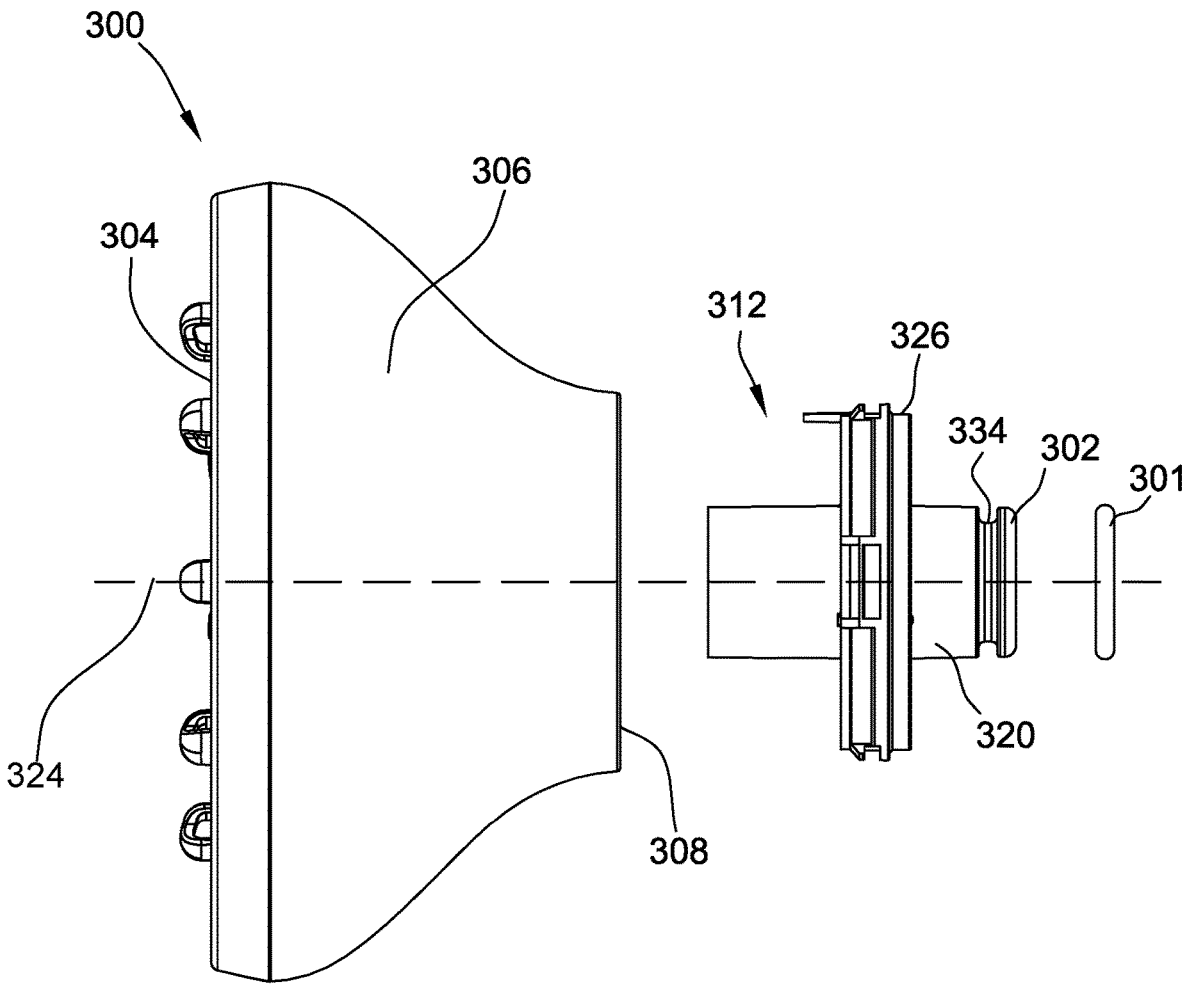
FIG. 13 is an exploded top view of the diffuser attachment shown in FIG. 10.

As shown in FIGS. 11 and 13, the grip feature 301 is received in a groove 334 in the wall 320. The groove 334 extends circumferentially around the wall 320. Accordingly, the grip feature 301 may be positioned in the groove 334 and extend at least partially around the wall 320. In the illustrated embodiment, the grip feature 301 is substantially continuous and extends around the entire circumference of the wall 320. A width of the grip feature 301 is larger than the depth of the groove 334 such that the grip feature 301 extends out of the groove when the grip feature 301 is disposed in the groove 334. In the illustrated embodiment, the grip feature 301 includes a circular elastic member, e.g., an O-ring. In other embodiments, the diffuser attachment 300 may include any grip feature 301 that enables the diffuser attachment 300 to operate as described herein. For example, in some embodiments, the grip feature 301 includes a plurality of elements or pads spaced throughout the connector 312. In further embodiments, the grip feature 301 includes a roughened surface configured to induce friction. In some embodiments, the grip feature 301 extends along the wall 320 in an axial or longitudinal direction. In some embodiments, the grip feature 301 substantially covers the wall 320.

Figure 14:
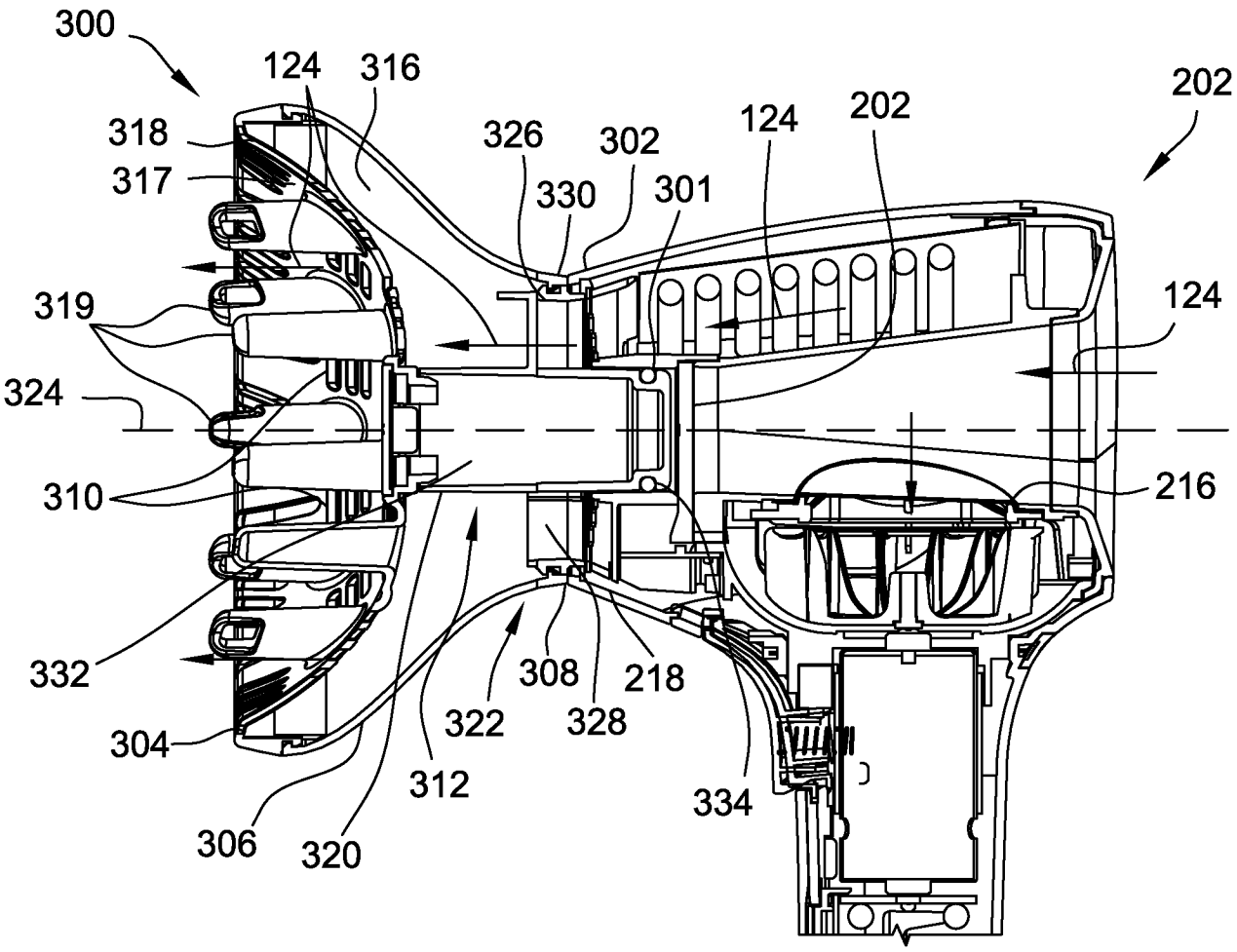
FIG. 14 is a sectional view of the diffuser attachment shown in FIG. 10 connected to the air-moving appliance shown in FIG. 8.

In reference to FIG. 14, the diffuser attachment 300 is configured to removably connect to the hair dryer 200. Specifically, the connector 312 is configured to extend into the central passage 214 of the hair dryer 200. The grip feature 301 is configured to extend between and contact the wall 320 of the connector 312 and the inner wall 212 of the hair dryer 200 when the connector 312 is positioned within the central passage 214. When the diffuser attachment 300 is connected to the hair dryer 200, the grip feature 301 provides an interference fit and resists movement of the diffuser attachment relative to the hair dryer. Accordingly, the diffuser attachment 300 may be connected to the hair dryer 200 without an engagement mechanism and without the use of tools. In addition, the grip feature 301 provides an interference fit along any portion of the inner wall 212 and does not require alignment with engagement features. As a result, the grip feature 301 may secure the diffuser attachment 300 to the hair dryer 200 even if the connector 312 is not fully inserted. Moreover, the interference fit of the grip feature 301 provides the feeling of a secure connection to assure a user that the diffuser attachment 300 will remain connected to the hair dryer 200 during operation.

When the diffuser attachment 300 is connected to the hair dryer 200, the inlet 308 of the diffuser attachment is aligned with the outlet 218 of the hair dryer. Accordingly, the inlet 308 of the diffuser attachment 300 receives airflow 124 from the outlet 218 of the hair dryer 200 during operation of the hair dryer 200. The airflow 124 received from the hair dryer 200 is directed through the passage 316 and discharged through the outlet 310.

During assembly, the grip feature 301 is positioned within the groove 334 and the diffuser attachment 300 and the grip feature are positioned relative to the hair dryer 200 as an assembly. In other embodiments, the grip feature 301 may be coupled to the hair dryer 200 such that the diffuser attachment 300 is moved relative to the grip feature. In further embodiments, the grip feature 301 may be positioned relative to the diffuser attachment 300 and the hair dryer 200 during connection of the diffuser attachment 300 to the hair dryer 200.

The central passage 214 is sized and shaped to receive the connector 312 of the diffuser attachment 300. Specifically, the central passage 214 and the connector 312 have corresponding cylindrical shapes. The central passage 214 has a first width. The connector 312 has a second width that is equal to or slightly less than the first width. Accordingly, the wall 320 may be configured to contact the inner wall 212 when the connector 312 is inserted into the central passage 214. The grip feature 301 extends between the wall 320 and the inner wall 212 and is deformed when the connector 312 is inserted into the central passage. Moreover, the grip feature 301 is elastic and moves towards a neutral state when it is deformed. Accordingly, the grip feature 301 is biased toward the wall 320 of the diffuser attachment 300 and the inner wall 212 of the hair dryer 200 when the grip feature 301 is pinched between the wall 320 and inner wall 212. As a result, the grip feature 301 provides an interference fit between the diffuser attachment 300 and the hair dryer 200. In some embodiments, a gap may be defined between at least a portion of the wall 320 and the inner wall 212. In such embodiments, the grip feature 301 may extend across the gap to contact the wall 320 and the inner wall 212.

The stop 322 is configured to contact the hair dryer 200 and limit insertion of the connector 312 into the central passage 214. In addition, in some embodiments, the stop 322 may include a screen or guard to inhibit objects moving into and out of the passage 316 of the diffuser attachment 300. In the illustrated embodiment, the stop 322 prevents the connector 312 from contacting the shield 202. In other embodiments, the connector 312 may be inserted into the central passage 214 such that the connector 312 abuts the shield 202.

Figure 15:
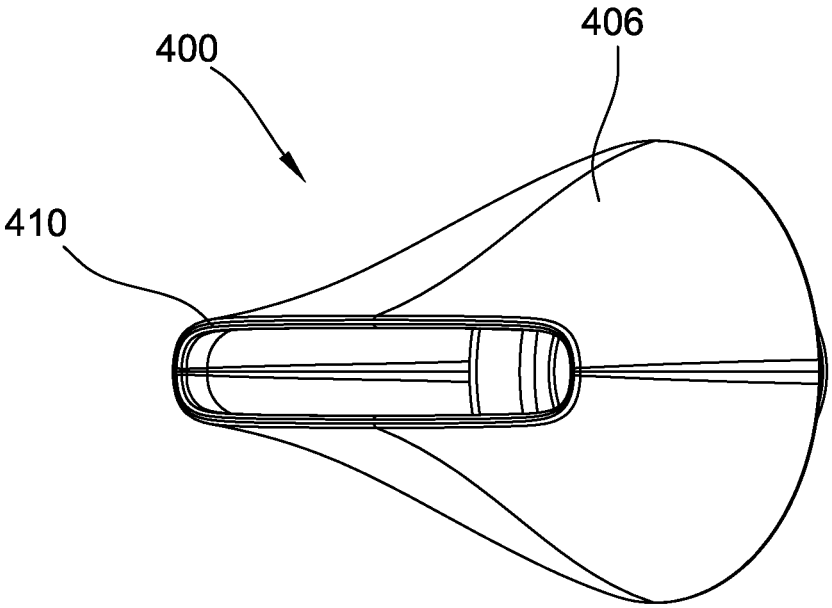
FIG. 15 is perspective view of a concentrator attachment for use with the air-moving appliances shown in FIGS. 1 and 8.
Figure 16:
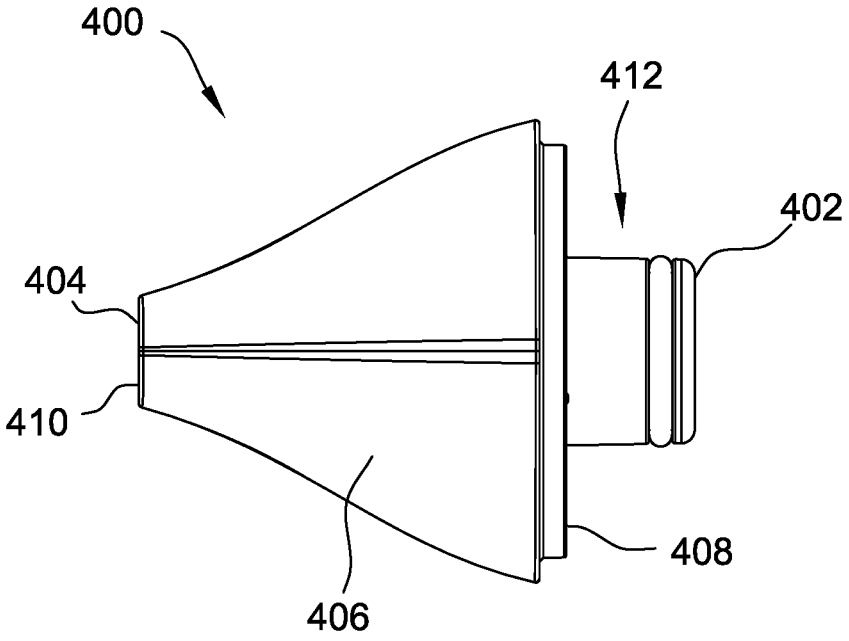
FIG. 16 is a side view of the concentrator attachment shown in FIG. 15.
Figure 17:
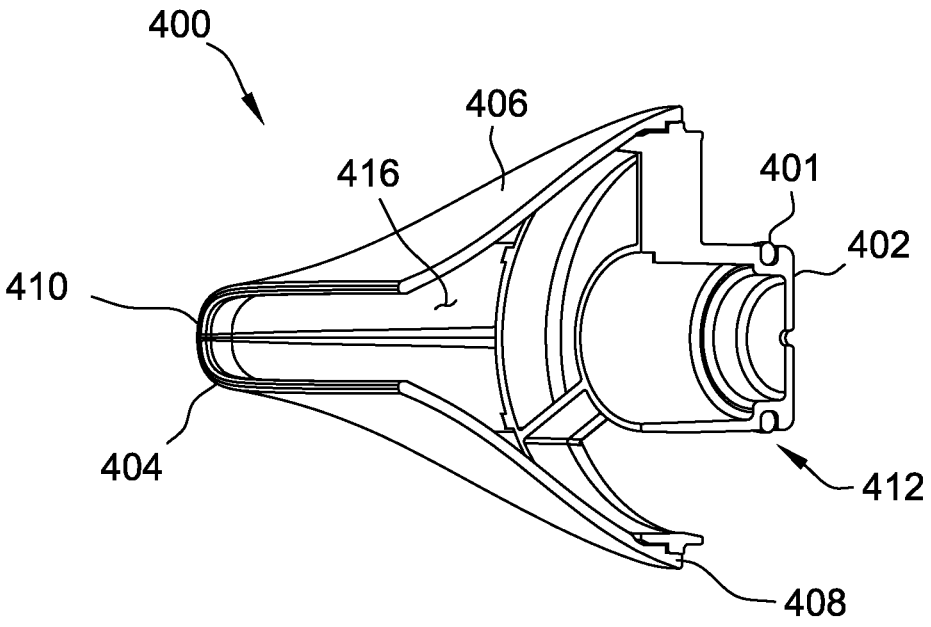
FIG. 17 is a sectional view of the concentrator attachment shown in FIG. 15.
Figure 18:
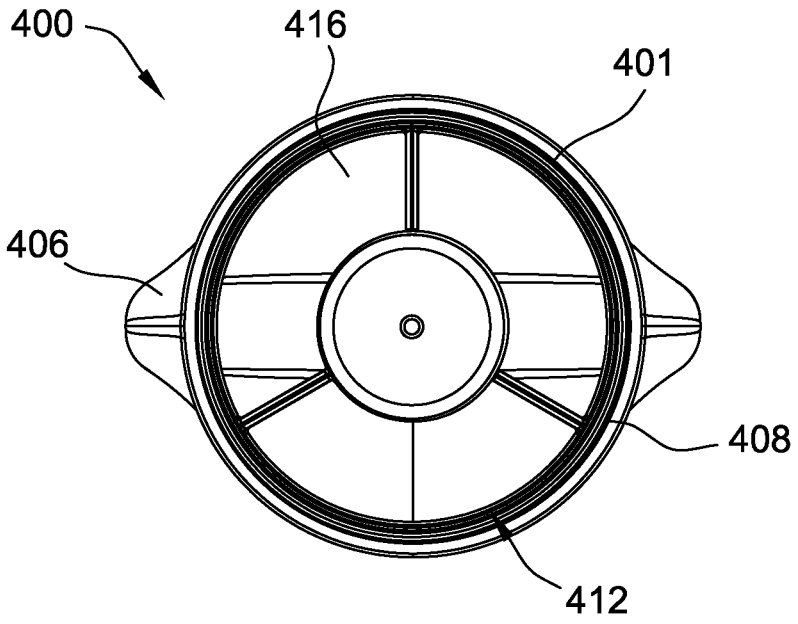
FIG. 18 is a rear view of the concentrator attachment shown in FIG. 15.

FIG. 15 is perspective view of a concentrator attachment 400 for use with air moving appliances such as the hair dryer 100 (shown in FIG. 1) and the hair dryer 200 (shown in FIG.

8). In reference to FIGS. 15-18, the concentrator attachment 400 includes a first end 402, a second end 404, a body 406, an inlet 408, an outlet 410, and a connector 412. A grip feature 401 is configured to removably connect the first end 402 to an air-moving appliance such that the concentrator attachment 400 at least partially covers one of an inlet and an outlet of the air-moving appliance. The grip feature 401 facilitates the user connecting and disconnecting the concentrator attachment 400 and the air-moving appliance as described herein.

In the illustrated embodiment, the inlet 408 is substantially annular and extends about the connector 412. The outlet 410 includes an elongate slot having a cross-sectional area less than the cross-sectional area of the inlet 408. The body 406 defines a passage 416 extending from the inlet 408 to the outlet 410. The body 406 has a funnel or cone shape and has a decreasing width from the inlet 408 to the outlet 410. Accordingly, the concentrator attachment 400 is configured to receive an airflow through the inlet 408 and discharge the airflow through the outlet 410 at an increased flowrate towards a focused location, i.e., concentrate the airflow. In other embodiments, the concentrator attachment 400 may have any configuration that enables the concentrator attachment to operate as described herein.

The connector 412 is substantially similar to the connector 312 (shown in FIG. 13). Accordingly, the connectors 312 and 412 are modular and may be used with different attachments. For example, the connector 312 may be used with the concentrator attachment 400 and the connector 412 may be used with the diffuser attachment 300 (shown in FIG. 10). In other embodiments, the connector 412 may be used with any suitable attachment including, for example and without limitation, a concentrator, a diffuser, a pick, a nozzle, a straightener, a brush, a tool, and a wand. In some embodiments, the connector 412 may be omitted without departing from some aspects of the invention.

In addition, the grip feature 401 is substantially similar to the grip feature 301 (shown in FIG. 13). For example, in some embodiments, the grip features 301 and 401 each include an O-ring having a standard size. Accordingly, the grip features 301 and 401 may be compatible with multiple air-moving appliances. In addition, the grip features 301 and 401 may reduce the cost to assemble and operate the air-moving appliances. For example, the grip features 301 and 401 may be inexpensive in comparison to other components of air-moving appliances and may be easily inexpensively replaced. In some embodiments, the grip features 301 and 401 may be replaced without removing and/or replacing other components of the air-moving appliance and/or the attachment.

Figure 19:
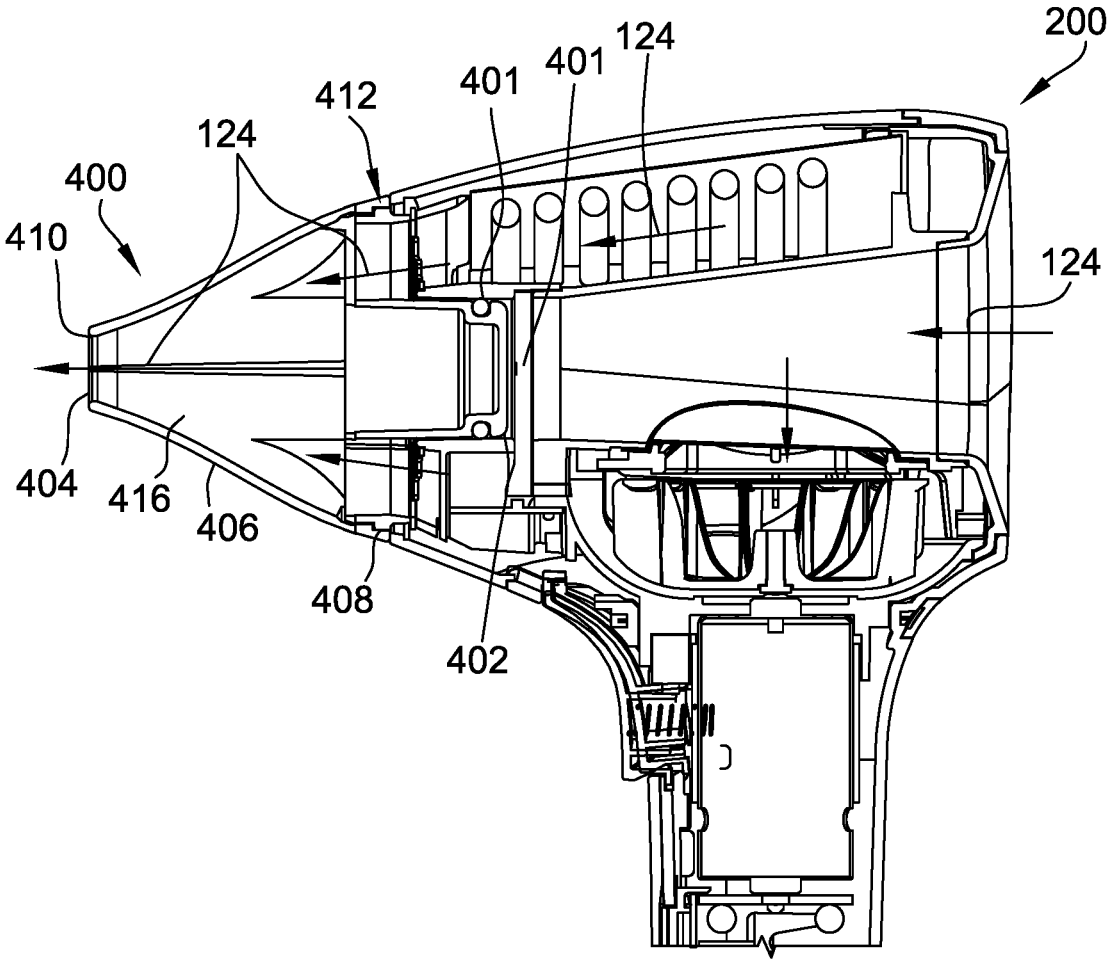
FIG. 19 is a sectional view of the concentrator attachment shown in FIG. 10 connected to the air-moving appliance shown in FIG. 8.

In reference to FIG. 19, the concentrator attachment 400 is configured to removably connect to the hair dryer 200. Specifically, the connector 412 extends into the central passage 214. The grip feature 401 extends between and contacts the connector 412 and the inner wall 212 of the hair dryer 200 when the connector 412 is positioned within the central passage 214. The grip feature 401 provides an interference fit and enables the concentrator attachment 400 to be quickly and easily connected to and disconnected from the hair dryer 200.

When the concentrator attachment 400 is connected to the hair dryer 200, the inlet 408 of the concentrator attachment is aligned with the outlet 218 of the hair dryer. During operation of the hair dryer 200, the inlet 408 of the concentrator attachment 400 receives airflow 124 from the outlet 218 of the hair dryer 200. The airflow 124 received from the hair dryer 200 is directed through the passage 416 and discharged through the outlet 410.

Figure 20:
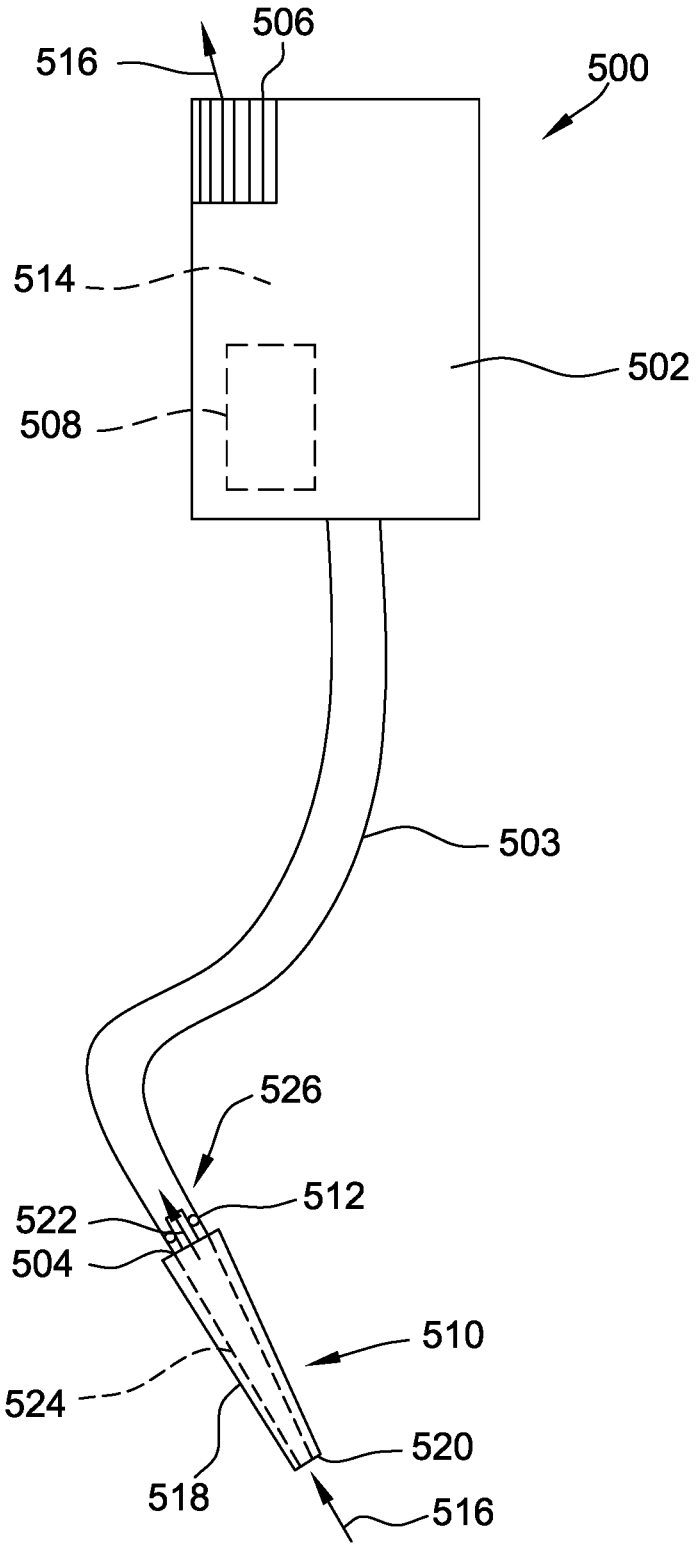
FIG. 20 is a schematic view of a third embodiment of an air-moving appliance.

Referring to FIG. 20, another embodiment of an air-moving appliance is generally indicated at 500. The air-moving appliance 500 includes a body 502, a tube 503, an inlet 504, an outlet 506, a motor 508, an attachment 510, and a grip feature 512. The motor 508 is disposed within a cavity 514 defined by the body 502 and the tube 503. In other embodiments, the air-moving appliance 500 may have any configuration that enables the air-moving appliance to operate as described herein. For example, in some embodiments, the air-moving appliance 500 may be in the form of a vacuum cleaner, a blower, a dryer, a pump, and any other suitable air-moving appliance.

During operation, the air-moving appliance 500 is configured to draw airflow 516 into the cavity 514 through the inlet 504. The airflow 516 is directed through the cavity 514 and discharged from the cavity through the outlet 506. In some embodiments, the air-moving appliance 500 may be configured to draw airflow 516 into the cavity through the outlet 506 and discharge the airflow through the inlet 504. In other embodiments, the air-moving appliance 500 may be configured to direct airflow 516 in any direction.

The attachment 510 is configured to connect to the inlet 504 at a distal end of the tube 503. The attachment includes a wall 518, an inlet 520, and an outlet 522. The wall 518 defines a passage 524 extending between the inlet 520 and the outlet 522. The attachment 510 also includes a connector 526 configured to extend into the cavity 514. In other embodiments, the attachment 510 may be connected to the air-moving appliance 500 in any manner that enables the air-moving appliance 500 to operate as described herein. For example, in some embodiments, the connector 526 may be omitted. In further embodiments, the attachment 510 may be configured to extend about a portion of the tube 503.

The grip feature 512 is configured to extend between and contact the connector 526 and the tube 503 when the attachment 510 is connected to the tube. For example, in the illustrated embodiment, the grip feature 512 is sized to extend across a gap between the connector 526 and the tube 503. The grip feature 512 provides an interference fit between the attachment 510 and the tube 503. In some embodiments, the grip feature 512 may be compatible with different attachments 510 and/or air-moving appliances 500 because the grip feature 512 is elastic and is able to change shape. In other embodiments, the air-moving appliance 500 may include any grip feature 512 that enables the air-moving appliance to operate as described herein.

During operation, the airflow 516 is directed into the air-moving appliance 500 through the attachment 510. Specifically, the airflow 516 is drawn into the passage 524 of the attachment 510 through the inlet 520. The airflow 516 is directed through the passage 524 and toward the cavity 514. The airflow 516 passes through the outlet 522 of the attachment and is drawn into the cavity 514 through the inlet 504 of the air-moving appliance 500. In other embodiments, the airflow 516 may move through the attachment 510 in any manner that enables the air-moving appliance 500 to operate as described herein. For example, in some embodiments, the attachment 510 may receive airflow 516 that is discharged from the cavity 514 of the air-moving appliance 500.

The air-moving appliance 500 may include any attachment 510 that enables the air-moving appliance to operate as described herein. For example, in some embodiments, the air-moving appliance 500 may include, without limitation, a concentrator, a diffuser, a pick, a nozzle, a straightener, a brush, a tool, a wand, and an extender. In the illustrated embodiment, the attachment 510 is elongate and increases in width from the inlet 520 to the outlet 522. Accordingly, the attachment 510 may enable the air-moving appliance 500 to access locations that are difficult to access using the tube 503.

As described above, embodiments of an air-moving appliance include an attachment and a grip feature. The grip feature enables the attachment to be easily connected to and disconnected from the air-moving appliance. The grip feature provides an interference fit and resists movement of the attachment when the attachment is coupled to the air-moving appliance. Accordingly, the grip feature reduces the cost to assemble and operate the air-moving appliances. In addition, the grip feature provides a connection that feels more secure to a user than the connection between air-moving appliances and at least some known attachments. In addition, in some embodiments, components of the air-moving appliances and/or the attachments may be modular to increase the compatibility of the air-moving appliances with different attachments and/or the attachments with different air-moving appliances.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An air-moving appliance comprising:

a body extending about an axis, the body including an inner wall and an outer wall spaced radially outward from the inner wall, the inner wall and the outer wall defining a cavity therebetween, the inner wall defining a central passage;

an inlet for airflow to enter the cavity defined by at least one of the inner wall and the outer wall;

an outlet for the airflow to exit the cavity, wherein the outlet is circumferentially outward of the central passage; and an attachment configured to selectively connect to the body in flow communication with the outlet, the attachment comprising:

a connector configured to extend into the central passage defined by the inner wall of the body, the connector including a wall having a shape that corresponds to the shape of the central passage, a collar extending about the wall, and braces extending between the wall and the collar, the collar and the braces forming a stop configured to contact the body of the air-moving appliance and limit insertion of the connector into the central passage, wherein the wall defines a hollow inner space that is sealed from the central passage; and an attachment inlet configured to receive the airflow that exits the cavity of the body through the outlet, wherein the attachment inlet is circumferentially disposed about the axis and the central passage defined by the inner wall of the body when the attachment is connected to the body.

2. An air-moving appliance as set forth in claim 1, wherein the outlet and the attachment inlet each have an annular shape.

3. An air-moving appliance as set forth in claim 1, wherein the wall and the collar define the attachment inlet therebetween.

4. An air-moving appliance as set forth in claim 1, wherein the attachment further comprises a grip feature configured to extend between and contact the attachment and the body when the attachment is connected to the body, wherein the grip feature is configured to provide an interference fit between the attachment and the body and resist movement of the attachment relative to the body when the attachment is connected to the body.

5. An air-moving appliance as set forth in claim 4, wherein the grip feature is elastic and is configured to extend about the connector.

6. An air-moving appliance as set forth in claim 1, wherein the air-moving appliance is a hair dryer, and the attachment comprises at least one of a concentrator, a diffuser, a pick, a nozzle, a straightener, a brush, a tool, and a wand.

7. An air-moving appliance as set forth in claim 1, wherein the wall is configured to extend about the body when the attachment is connected to the body.

8. An air-moving appliance as set forth in claim 1, wherein the inlet is defined by the inner wall, and the air-moving appliance is configured to draw airflow into the inlet from the central passage.

9. An air-moving appliance comprising:

a body extending about an axis, the body including an inner wall and an outer wall spaced radially outward from the inner wall, the inner wall and the outer wall defining a cavity therebetween, the inner wall defining a central passage;

an inlet for airflow to enter the cavity defined by at least one of the inner wall and the outer wall;

an outlet for the airflow to exit the cavity, wherein the outlet is circumferentially outward of the central passage;

a shield coupled to the inner wall at a location between the outlet and the inlet and configured to extend across the central passage; and an attachment configured to selectively connect to the body in flow communication with the outlet, the attachment comprising:

a connector configured to extend into the central passage defined by the inner wall of the body, the connector having a shape that corresponds to the shape of the central passage; and an attachment inlet configured to receive the airflow that exits the cavity of the body through the outlet, wherein the attachment inlet is circumferentially disposed about the axis and the central passage defined by the inner wall of the body when the attachment is connected to the body.

10. An attachment for an air-moving appliance, the attachment comprising:

a first end configured to selectively connect to a body of the air-moving appliance;

a second end spaced from the first end;

a body defining a passage for airflow between the first end and the second end; and a connector configured to extend into a central passage defined by the body of the air-moving appliance and connect the first end of the attachment to the body of the air-moving appliance, wherein the connector includes:

a wall having a shape that corresponds to the shape of the central passage, wherein the wall defines a hollow inner space that is sealed from the central passage;

a collar that extends about the wall, the collar and the wall defining an annular inlet configured to receive airflow from an outlet of the air-moving appliance; and braces extending between the wall and the collar, the collar and the braces forming a stop configured to contact the body of the air-moving appliance and limit insertion of the connector into the central passage.

11. An attachment as set forth in claim 10, wherein the attachment and the connector are integrally formed.

12. An attachment as set forth in claim 10, wherein the connector is configured to removably connect to the attachment.

13. An attachment as set forth in claim 10 further comprising a grip feature configured to extend between and contact the connector and the body of the air-moving appliance when the attachment is connected to the body of the air-moving appliance, wherein the grip feature is configured to provide an interference fit between the attachment and the body of the air-moving appliance and resist movement of the attachment relative to the body of the air-moving appliance when the attachment is connected to the body of the air-moving appliance.

14. An attachment as set forth in claim 10, wherein the wall is cylindrical and the collar extends about and is spaced radially from the wall.

15. An attachment as set forth in claim 10, wherein the body is shaped such that an area of the passage varies between the first end and the second end and the body redirects the airflow that is received from the body of the air-moving appliance within the passage.

16. An attachment kit for an air-moving appliance, the kit comprising:

a first attachment;

a second attachment; and a connector configured to extend into a central passage of the air-moving appliance, wherein the connector is configured to connect at least one of the first attachment and the second attachment to the air-moving appliance, the connector comprising:

a cylindrical wall having a shape that corresponds to a shape of the central passage, the cylindrical wall configured to extend into the central passage, wherein the cylindrical wall defines a hollow inner space that is sealed from the central passage; and a collar extending about and spaced radially from the cylindrical wall, the collar and the cylindrical wall defining an annular inlet therebetween configured to receive airflow from the air-moving appliance.

17. An attachment kit as set forth in claim 16, wherein the connector is configured to removably connect to the first attachment and the second attachment.

18. An attachment kit as set forth in claim 16, wherein the connector further comprises a grip feature configured to extend between and contact the connector and the air-moving appliance, wherein the grip feature is configured to provide an interference fit between the connector and the air-moving appliance and resist movement of the first attachment or the second attachment relative to the air-moving appliance when the first attachment or the second attachment is connected to the air-moving appliance.

19. An attachment kit as set forth in claim 16, wherein the first attachment further comprises a body defining an attachment passage, the body extending about the cylindrical wall of the connector.

* * * * *